US005313988A

United States Patent [19]

Bilcke et al.

[11] Patent Number: 5,313,988

[45] Date of Patent: May 24, 1994

[54] METHOD AND DEVICE FOR DRIVING A WEAVING MACHINE DURING SLOW MOTION

[75] Inventors: Walter Bilcke, Geluveld-Zonnebeke; Ludo Faes, Roesbrugge-Poperinge; Chris Noppe, Meulebeke, all of Belgium

[73] Assignee: Picanol N.V., naamloze venootschap, Ypres, Belgium

[21] Appl. No.: 887,939

[22] Filed: May 26, 1992

[30] Foreign Application Priority Data

May 23, 1991 [BE] Belgium ..... 09100490

[51] Int. Cl.[5] ..... D03D 51/00; D03D 51/14

[52] U.S. Cl. ..... 139/1 E; 318/430; 388/930; 139/116.2

[58] Field of Search ..... 318/430, 116.2; 139/1 E; 388/930

[56] References Cited

U.S. PATENT DOCUMENTS

Re. 33,379 10/1990 Bradus ..... 388/930 X
4,592,392 6/1986 Vandeweghe et al. ..... 139/1 E
4,609,858 9/1986 Sugita et al. ..... 139/1 E X
4,969,757 11/1990 Spina ..... 388/930 X

FOREIGN PATENT DOCUMENTS 2309914 11/1976 France .

*Primary Examiner*—Andrew M. Falik
*Attorney, Agent, or Firm*—Bacon & Thomas

[57] ABSTRACT

A method for driving a weaving machine during slow motion includes the steps of carrying out the slow motion drive using the main drive motor, and controlling excitation of the main drive motor as a function of the load on the weaving machine parts which has been predetermined and stored in a memory as a function of weaving machine part positions. The required speed of the weaving machine parts to be driven may also be taken into account in controlling the main drive motor. A device for carrying out the method includes the main drive motor, a power phase controller for the main drive motor, detectors for detecting the positions of the weaving machine parts, and a comparator for comparing the positions with stored positions in order to take into account the load data which has been entered.

21 Claims, 2 Drawing Sheets

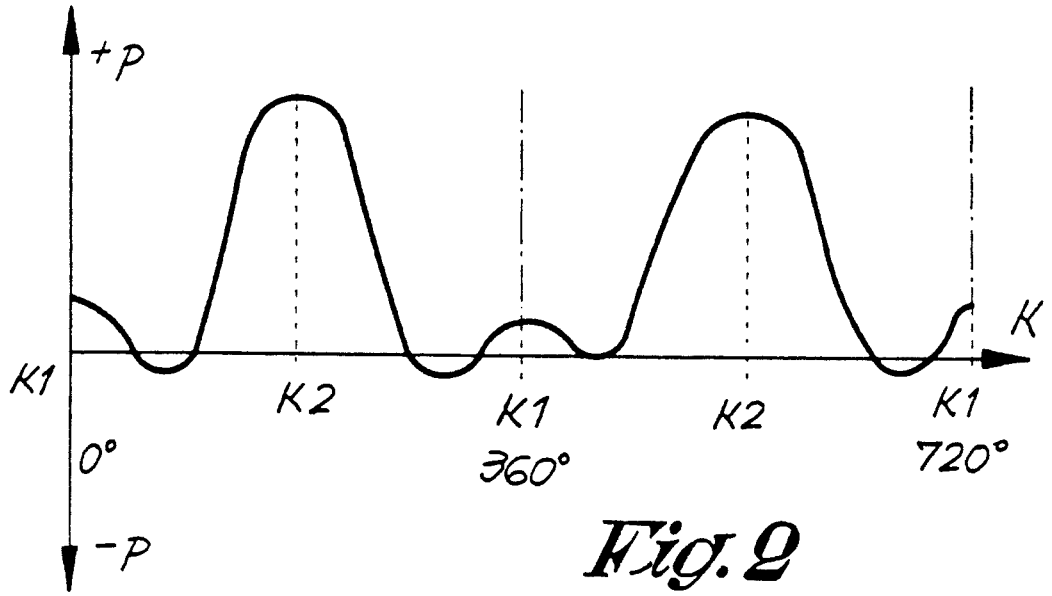
Fig. 2
Fig. 3
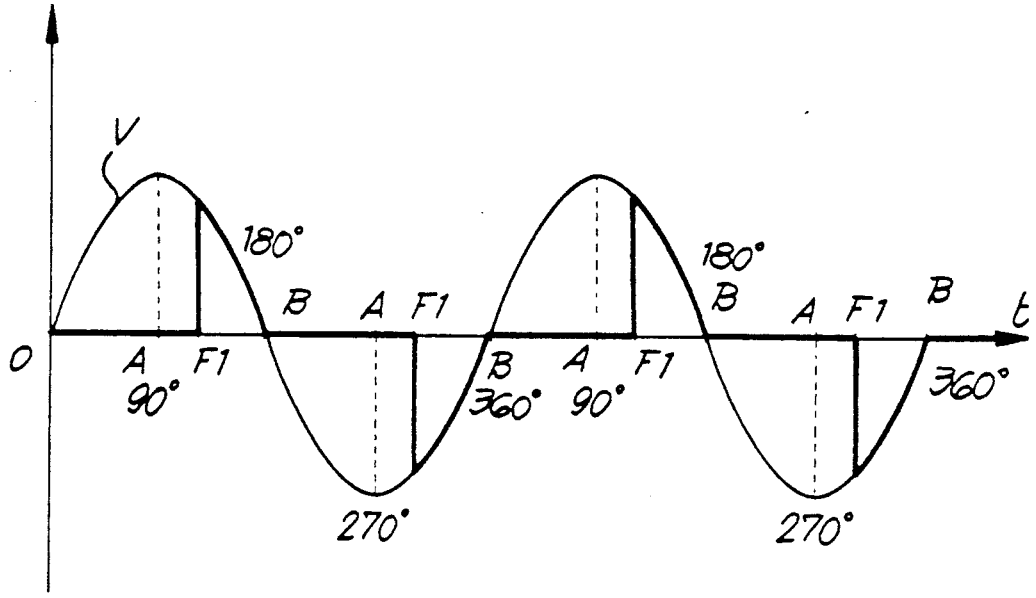

METHOD AND DEVICE FOR DRIVING A WEAVING MACHINE DURING SLOW MOTION

BACKGROUND OF THE INVENTION

The present invention concerns a method and device for driving a weaving machine in slow motion, i.e., at a lower than normal speed.

It is known that it must be possible for a weaving machine to be driven, apart from the normal speed, at a lower speed, both forward and backward, so as to make it possible for a number of weaving machine parts, such as the sley and the harnesses, to be positioned precisely.

Due to increasing weaving machine automation, for example the development of weaving machines having automatic weft repair functions, the accuracy with which the above-mentioned parts must be positioned has to meet ever more stringent demands.

Moreover, it is desirable that the time required to complete a certain action, such as the automatic repair of a weft thread, in which the sley must be successively put in different positions, be kept to a minimum.

It is generally known that for the slow motion of a weaving machine, or at least for the slow motion of a number of parts of the weaving machine, use is made of an auxiliary drive motor. In order to switch on the auxiliary drive motor during the slow motion, use is made of a slow motion clutch, for example as described in U.S. Pat. No. 4,592,392. This clutch provides for a large transmission ratio, such that the auxiliary drive motor can run at a normal speed, whereas the driven parts make a relatively slow movement.

The use of an auxiliary drive motor and slow motion clutch is disadvantageous in that the slow motion always has the same speed, depending on the transmission ratio and/or auxiliary drive motor used. In the case where a relatively low speed is used, there is a disadvantage in that the slow moving of the sley and/or the harnesses takes too much time. In the case where a relatively high speed is used, however, there is a disadvantage in that an exact positioning of the driven weaving machine parts is practically impossible, since it is very difficult then to bring these parts to a standstill in the required position.

It is also known to realize the slow motion drive by means of the main drive motor, by making this main drive motor run at a certain lower speed. To this end, the main drive motor can for example be excited via a separate, low frequency supply system. However, this known technique is disadvantageous in that the machine makes a very irregular movement and in that it is difficult to stop the machine at the required place.

SUMMARY OF THE INVENTION

The present invention aims to provide a method and device for driving a weaving machine, whereby slow motion movement can be realized such that a very precise and fast positioning of the weaving machine parts is possible, without requiring a separate auxiliary drive motor or a separate supply system.

To this end the invention concerns a method for driving the weaving machine during the slow motion, in particular a weaving machine of the type whereby the slow motion is carried out by means of the main drive motor, characterized in that the excitation of the main drive motor during the slow motion is controlled while the load of the weaving machine parts to be driven is taken into account.

Preferably, the main drive motor is also controlled during the slow motion while the required speed of the weaving machine parts to be driven is taken into account.

According to a preferred embodiment the excitation of the main drive motor during the slow motion is controlled as a function of the position of one or several weaving machine parts, whereby the load of each position is taken into account. In particular, the drive preferably takes place as a function of the angle position of the main shaft and as a function of the insertion concerned in the weaving cycle.

The control of the main drive motor is preferably carried out by means of an electronic power control, for example a phase control in case of an asynchronic main drive motor.

According to an especially preferred embodiment, the brake of the weaving machine is excited while taking at least the load into account.

BRIEF DESCRIPTION OF THE DRAWINGS

In order to better explain the characteristics of the invention, by way of example only and without being limitative in any way, the following preferred embodiments are described with reference to the accompanying drawings where:

FIG. 2 is a graph showing an example of variations in the load on the drive of a weaving machine for a weaving cycle in accordance with a preferred embodiment of the invention;

FIG. 3 is a graph showing an example of a voltage curve used to excite the main drive motor in accordance with a preferred embodiments of the invention.

DETAILED DESCRIPTION OF THE PREFERRED EMBODIMENTS

Figure 1:
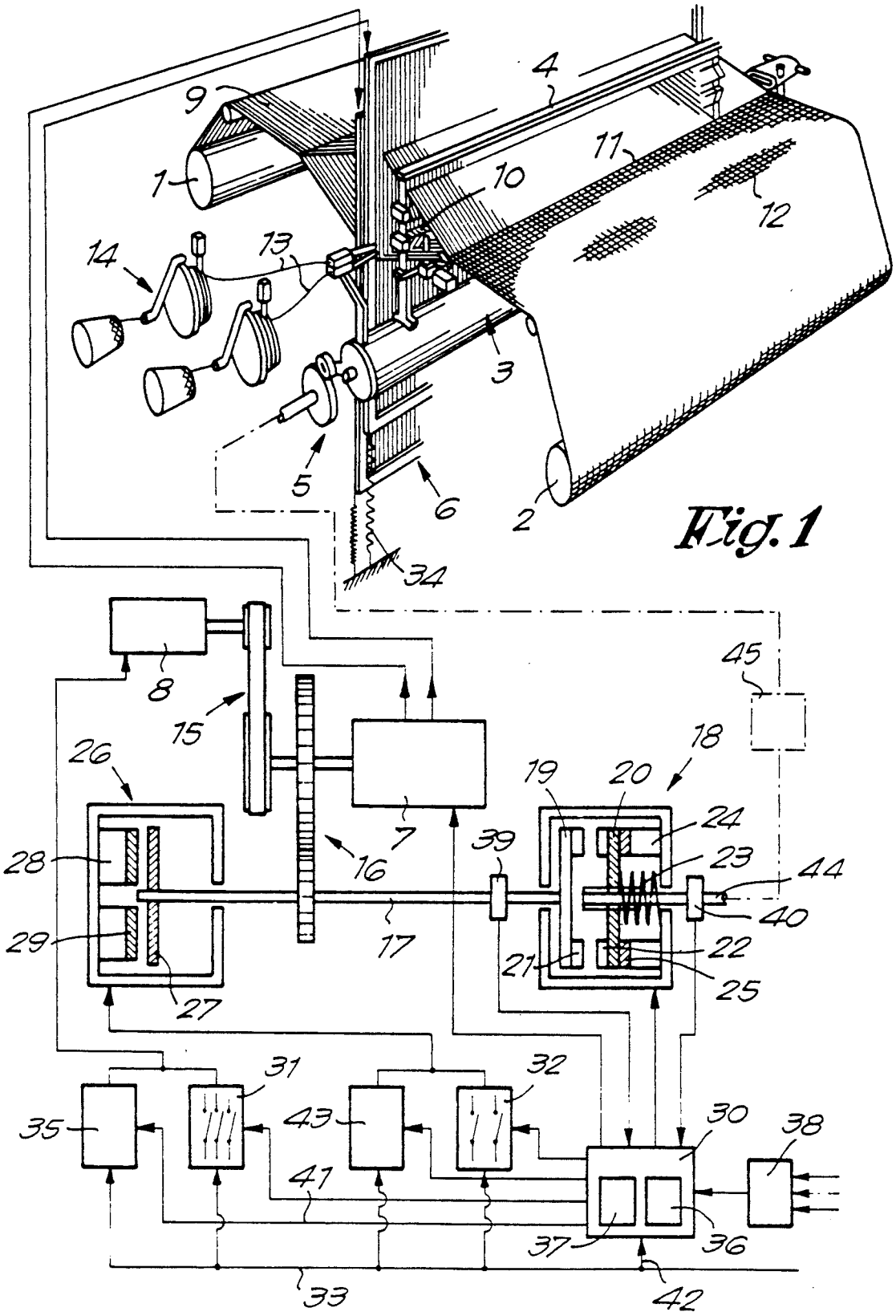
FIG. 1 is a schematic view of a device according to a preferred embodiment the invention.

FIG. 1 is a schematic representation of a weaving machine having as main parts the warp beam 1; the cloth roll 2; the sley 3 with the reed 4; the cam drive 5 to move the sley 3; the harnesses 6; the harness drive or dobby 7 which provides for the up and down movement of the harnesses 6; and the main drive motor 8. Also the warp threads 9, the shed 10, the cloth line 11 and the fabric being woven 12 are represented.

As is known the shed 10 is formed by the movement of the harnesses 6 and the fabric 12 is woven as weft threads 13 are inserted in the shed 10 by means of weft insertion means 14 and subsequently beaten against the cloth line 11 as a result of the to and fro movement of the reed 4.

The main drive motor 8 provides for the drive of the dobby 7 and of the sley 3. In the example shown the main drive motor 8 is coupled to this end to the dobby 7 by means of a transmission 15. The cam drive 5 is in turn also coupled to it by means of a transmission 16 and a shaft 17, which forms the main shaft of the weaving machine.

A clutch 18 may have been either applied or not applied between the main shaft 17 and the cam drive 5 which makes it possible for the drive of the sley 3 to be disconnected, such that the harnesses 6 can be moved without the sley 3 making a movement. This clutch 18 consists for example of two clutch parts 19 and 20 which can act on each other by means of claws or gears 21 and 22. The clutch parts 19 and 20 are pressed onto each other by means of elastic means 23, and can be disconnected through the engagement of an electromagnet 24.

The clutch 18 may also contain a brake 25, such that the clutch part 20 which is connected to the cam drive 5 is locked, so that it cannot rotate as the clutch 18 is disconnected.

In order to stop the weaving machine, use is made of a brake 26 on the main shaft 17. In the example shown, this brake 26 consists of a disc 27 which has been mounted on the main shaft 17 and which can be pulled against a fixed brake shoe 29 by means of an electromagnet 28.

The different parts are controlled by means of a control unit 30, such that during the weaving process the main drive motor 8 and the brake 26 can be switched on by means of switch means 31 and 32, as a result of which motor 8 and brake 26 are either connected or not connected to the supply system 33.

It is known that the load of the different weaving machine parts on the main drive motor 8 depends on the position of the harnesses 6 and the position of the sley 3.

When the harnesses 6 have shifted in relation to one another, and thus when an open shed 10 has been formed, the warp threads 9 exert a force on the harnesses 6 which is proportional to the tension in the warp threads 9 and to the size and geometry of the shed 10. In order to form an open shed 10, the main drive motor 8 must exert a force which counteracts the above-mentioned force. On the other hand, during the closing of the shed 10, the harnesses 6, under influence of the tension in the warp threads 9, exert a cooperating rather than counteracting force.

When the harnesses 6, as shown in FIG. 1, are pulled back in one direction by means of springs 34, a force must be exerted as the harnesses 6 are moved against the force of the springs 34. However, at the same time the harnesses 6 which move in the opposite direction are pulled back by the springs and thus exert a cooperating rather than a counteracting force on the drive of the weaving machine.

During the beat-up movement, when reed 4 makes contact with the cloth line 11, the fabric 12 is pushed forward, thereby stretching the warp threads 9. To this end an increased force must be exerted by the sley 3, and the main drive motor 8. During the return movement of the sley 3 the cloth line 11 springs back, as a result of which the fabric 12 exerts a cooperating rather than a counteracting force on the movement of the sley 3.

From the above it is clear that the load of the main drive motor 8 is the result of various cooperating and counteracting components.

FIG. 2 shows an example of the variation of the load of a weaving machine as a function of the crank degrees K for a weaving cycle of two insertions. In case of a positive load +P, the main drive motor 8 should exert a force on the weaving machine parts, whereas in case of a negative load −P the weaving machine parts should exert a driving force on the main drive motor 8. In the example shown, the beat-ups occur on the moments K1. The shed 10 is entirely opened on the moments K2.

As the load during the movement of the weaving machines varies strongly, there is a problem in that it is difficult to obtain a regular movement of the parts of the machine when the speed is low. As a result, positioning of the parts is also very difficult.

The present invention offers a remedy to this by controlling the excitation of the main drive motor 8 during the slow motion as a function on the load of the weaving machine parts to be driven.

Preferably, the main drive motor 8 is controlled during the slow motion by means of a control unit 35, which is controlled in turn by means of the control unit 30, such that the main drive motor 8 is excited as a function of the load and as a function of the required speed. The switch means 31 makes it possible to disconnect the direct coupling from the supply system 33 and to excite the main drive motor 8 during the slow motion of the weaving machine by means of the above-mentioned control unit 35.

In order to control the control unit 35, the control unit 30 has been provided with a memory 36 and a comparator 37. Via the required input means 38 the variation of the load is entered in the memory 36 as a function of the position of the weaving machine parts and as a function of the insertion concerned in the weaving cycle.

The position of the weaving machine parts, in particular of the sley 3 and of the harnesses 6, is determined by means of one or several detection elements, such as a detector 39, to determine the position of the shaft 17 and a detector 40 to determine the position of the sley 3.

The comparator 37 determines for each of the measured positions the magnitude of the load required for this position, such that the main drive motor 8 can be excited accordingly.

It is a fact that for each weaving machine, for any position whatsoever of the parts, the required drive force or the force with which the weaving machine drives itself, can be determined. In a harness pattern, it is clear how the load of the weaving machine over several wefts or insertions varies. Depending on the position of the weaving harnesses 6, the movement of the sley 3 and the moment of the beat-up a load cycle can thus be set for any weaving machine, which may cover several weft cycles or insertions, representing the relation between the angular position of the shaft 17 and the accompanying load.

Preferably the control of the main drive motor 8 is such that the excitation is altered prior to a change in the load, such that the alteration has no delay effect.

Apart from the fact that the excitation of the main drive motor 8 is thus controlled as a function of the load, the main drive motor 8 is also excited such that it runs at the required speed.

The motor control unit 35 according to the invention preferably uses a phase control made up of an electronic circuit composed of AC motor power components. As shown in FIG. 3, in preference only a part of the alternating voltage V is provided to the main drive motor 8 such that the voltage is only transmitted as of a certain phase angle F1. In order to alter the excitation as a function of the load and the speed, the phase angle F1 is controlled depending on the signal 41 emitted by the control unit 30. In the example shown, the voltage can be transmitted from 90 to 180 degrees and from 270 to 360 degrees. By controlling the phase angle F1 at a given moment, the effective value of the transmitted voltage can thus be altered between nil and half of the alternating voltage V.

The electronic circuit of the control unit 35 is, as mentioned above, composed of electronic power components, which as is known are advantageous in that the transmitted voltage can be switched on and off without any mechanical moving part being required. No power is required for the control of the voltage as such, as a result of which there is practically no warming up of the above-mentioned electronic circuit.

In order to synchronize the signal 41 with the alternating voltage V, the control unit 30 for example has been connected via a line 42 to the supply system 33 and provided to this end with known electronic components.

It is clear that the alternating voltage V may be obtained through a connection to the normal supply system or through a connection to a special supply system, for example having a lower tension.

For each movement during the slow motion, the phase angle F1 is preferably set at 90 and 270 degrees respectively at the start, as a result of which a maximum force is obtained to start up the main drive motor 8. The phase angle F1 from FIG. 2 coincides in this case with the indicated points A. Subsequently, the phase angle F1 is altered such that the required speed of the weaving machine parts concerned is reached while, at the same time, the load to be expected is taken into account according to the load variation data entered in the memory 36.

By taking into account the load to be expected, the weaving machine parts can be moved at a very regular, desired speed during the slow motion.

Preferably, the required speed with which the slow motion is to be carried out is altered while the slow motion movement is being carried out.

The speed is also controlled as a function of the preset or required speed which can, just as the load, be stored in a memory, the control being realized by means of a feedback circuit which compares the actual speed to the required speed. The actual speed can for example be determined on the basis from the signals of the detector 39. During the control, use can be made of a proportional, integrating and differential control regulation. The control regulation can be adjusted to the load variation, such that for example in a certain load area, only a proportional control regulation is used.

When the required angle position of the main shaft 17 of the weaving machine is reached, the speed can be reduced by the phase control, such that the required position is reached at a low speed as a result of which the weaving machine parts can be precisely positioned. If the weaving machine parts must move over a very wide angle, the speed can be increased in the middle of this movement, such that a fast positioning becomes possible.

When the weaving machine parts have reached the required position, the brake 26 is forcefully controlled by the switch means 32, such that the above-mentioned weaving machine parts can be held in this position.

At the end of the movement, the brake 26 can also be engaged progressively via a phase control by means of a control unit 43, such that the brake is immediately active at the moment when the drive of the weaving machine parts must be stopped. The phase control is used to guide the current to the brake 26.

Since, as mentioned above, the load on the main drive motor 8 can also be negative, meaning that the weaving machine parts exert a cooperating force on the main drive motor 8, the device preferably also has a control unit 43 which makes it possible for the brake 26 to be also controlled as a function of the load, for example by means of a phase control to guide the current to the brake 26. It is obvious that the brake power is must be increased when the weaving machine parts supply a driving force which might lead to an undesired speed increase.

If, as shown in FIG. 1, use is made of a clutch 18 which makes it possible for the cam drive 5 of the sley 3 to be disconnected from the main drive motor 8, then two load variation settings are preferably stored in the memory 36 of the control unit 30, namely a first taking into account the sley and the harnesses and a second one which merely takes into account the harnesses.

During the slow motion movement, the dynamic forces required to speed up the weaving machine parts may also be taken into account. However, during the slow motion, the dynamic forces are in the proportion to the static forces and thus can usually be neglected.

For the main drive motor 8, use is preferably made of a three-phase, asynchronous motor having a flat motor characteristic, in other words a motor with a high starting torque. The main drive motor 8 can be connected both in a star and in a delta configuration. The above-mentioned phase control can be exerted on one or several of the three phases.

The method according to the invention has a double safety feature. The above-mentioned electronic circuit does not allow for the control angle of the phase to become smaller than 90, 270 degrees respectively, which means that maximally 50% of the alternating voltage V can be used. As a result, the weaving machine cannot start at a high speed in case the control regulation should get out of hand. On the other hand, if the detection means observe a speed which is higher than a certain limiting value, the control unit 30 disconnects the main drive motor 8 and engages the brake 26 so that the weaving machine comes to a standstill.

According to a variant a separate brake 45 can also be provided on the shaft 44 for the sley 3. In this case the brake 25 of the clutch 18 is no longer necessary. This embodiment makes it possible to close the brake 45 before the clutch 18 is disconnected, as a result of which shaft 44 retains its position from before the disconnection. In this case the detector 40 is also no longer required.

The separate brake 45 only has to exert a force required to keep the shaft 44 in its position. As said force is much smaller than the force required to slow down a weaving machine, the brake 45 can be made much lighter than the brake 26. The brake 45 may consist of a brake shoe which can be pressed against the shaft 44. The brake shoe is for example mounted on a lever which can be moved by means of a pneumatic cylinder so as to make the brake shoe operate in conjunction with the shaft 44.

The separate brake 45 can be engaged when the clutch 18 is closed. This makes it possible to engage the brake 45 at each standstill of the machine. When such pneumatically engageable brake 45 is used, the brake 45 can also serve as a safety device to keep the weaving machine parts in their position when the brake 26 unintentionally disengages, for example due to a current interruption.

It is clear that apart from the weaving machine parts shown, other weaving machine parts can also be present. For example, a split motion and a cloth take-up device can also be driven with the shaft of harness drive 7 similarly apart from the sley 3, a weft cutter, a waste cutter and a tucking-in device can also be driven by shaft 44. In the case of a gripper machine, the shaft 44 can also drive a gripper drive and thread presentation mechanism.

It is clear that during slow motion the movement can be both forward and backward. When the three-phase, asynchronous motor is used, this can be obtained by changing the sense of rotation of the main drive motor 8 by, for example, switching two phases.

The present invention is in no way limited to the embodiment described by way of example and shown in the accompanying drawings; on the contrary, such a method and device for driving a weaving machine during slow motion can be implemented using a variety of different variants while still remaining within the scope of the invention.

We claim:

1. A method of driving a weaving machine in slow motion, said weaving machine including a main drive motor, and parts which are driven by the main drive motor, comprising the steps of:

controlling excitation of the main drive motor during slow motion in response to a load exerted on the drive motor by weaving machine parts which are driven by the main motor and in response to positions of said parts which are driven by the main drive motor.

2. A method as claimed in claim 1, wherein the step of controlling excitation of the drive motor in response to a load comprises the step of storing predetermined load variations in a memory as a function of positions of the weaving machine parts to be driven by the main drive motor at which said load variations occur.

3. A method as claimed in claim 1, further comprising the step of controlling excitation of the drive motor during slow motion as a function of a required speed of the weaving machine parts to be driven.

4. A method as claimed in claim 3, wherein the step of controlling excitation of the main drive motor during slow motion as a function of a required speed comprises the step of storing required speed variation in a memory as a function of the positions of the weaving machine parts.

5. A method as claimed in claim 1, wherein the step of controlling excitation of the drive motor in response to a load comprises the step of controlling excitation of the drive motor as a function of a position of a main shaft of the weaving machine.

6. A method as claimed in claim 5, wherein the step of controlling excitation of the drive motor in response to a load comprises the step of controlling excitation of the drive motor as a function of insertions in relation to a weaving cycle.

7. A method as claimed in claim 1, wherein the step of controlling excitation of the drive motor includes the step of controlling a power supply to the main drive motor.

8. A method as claimed in claim 7, wherein the step of controlling a power supply to the main drive motor comprises the step of controlling a phase angle at which an alternating voltage is supplied to the motor.

9. A method as claimed in claim 1, further comprising the step of controlling an electromagnetic brake in response to the load.

10. A device for driving a weaving machine, comprising means including a main drive motor for driving a plurality of weaving machine parts, detection means for detecting a position of the weaving machine parts to be driven; means including a control unit for excitating the main drive motor; and means for controlling said excitation as a function of a load on the weaving machine parts driven by the drive motor.

11. A device as claimed in claim 10, further comprising means for controlling excitation of said main drive motor as a function of a required speed at which the weaving machine parts are to be driven.

12. A device as claimed in claim 10, further comprising an electromagnetic brake and means including a second control unit for controlling excitation of the brake as a function of the load on said weaving machine parts.

13. A method of driving a weaving machine in slow motion, said weaving machine including a main drive motor and weaving machine parts to be driven by the main drive motor, comprising the step of controlling excitation of the main drive motor during slow motion as a function of a required speed and of positions of the weaving machine parts to be driven.

14. A method as claimed in claim 13, wherein the step of controlling excitation of the main drive motor during slow motion as a function of a required speed and of positions of the weaving machine parts comprises the step of storing required speed variations in a memory as a function of the positions of the weaving machine parts, detecting the positions of the weaving machine parts, and controlling motor excitation based on a comparison between stored positions and detected positions.

15. A method as claimed in claim 13, wherein the step of controlling excitation of the drive motor includes the step of controlling a power supply to the main drive motor.

16. A method as claimed in claim 15, wherein the step of controlling a power supply to the main drive motor comprises the step of controlling a phase angle at which an alternating voltage is supplied to the motor.

17. A method as claimed in claim 13, further comprising the step of controlling an electromagnetic brake in response to the required speed.

18. A method as claimed in claim 13, wherein the step of controlling excitation of the drive motor in response to a required speed comprises the step of controlling excitation of the drive motor as a function of a position of a main shaft of the weaving machine.

19. A method as claimed in claim 18, wherein the step of controlling excitation of the drive motor in response to a required speed comprises the step of controlling excitation of the drive motor as a function of insertions in relation to a weaving cycle.

20. A device for driving a weaving machine, comprising means including a main drive motor for driving a plurality of weaving machine parts, detection means for detecting a position of the weaving machine parts to be driven; means including a control unit for excitating the main drive motor; and means for controlling excitation of said main drive motor as a function of a required speed at which the weaving machine parts are to be driven.

21. A device as claimed in claim 20, further comprising an electromagnetic brake and means including a second control unit for controlling excitation of the brake as a function of the required speed of said weaving machine parts.

* * * * *